US005816843A

United States Patent [19]

Gerberding

[11] Patent Number: 5,816,843

[45] Date of Patent: Oct. 6, 1998

[54] ELECTRICAL FRONT WIRING CLAMP

[75] Inventor: Wolfgang Gerberding, Hessisch Oldendorf, Germany

[73] Assignee: Wago Verwaltungsgesellschaft mbH, Minden, Germany

[21] Appl. No.: 740,422

[22] Filed: Oct. 29, 1996

[30] Foreign Application Priority Data

Oct. 30, 1995 [DE] Germany ..... 195 41 137.4

[51] Int. Cl.[6] ..... H01R 4/24

[52] U.S. Cl. ..... 439/410; 174/135

[58] Field of Search ..... 174/135, 44, 59, 174/60; 439/410, 409, 721, 406

[56] References Cited

U.S. PATENT DOCUMENTS

| | | | |
|---|---|---|---|
| 4,466,682 | 8/1984 | Jusseau et al. | 439/391 |
| 4,630,879 | 12/1986 | Van Alst | 439/402 |
| 5,118,305 | 6/1992 | Hell et al. | 439/396 |
| 5,127,846 | 7/1992 | Kollmann | 439/441 |
| 5,257,945 | 11/1993 | Heng et al. | 439/406 |
| 5,641,312 | 6/1997 | Bippus et al. | 439/709 |

FOREIGN PATENT DOCUMENTS

| | | | |
|---|---|---|---|
| 29 02 536 B1 | 4/1980 | Germany | H01R 9/06 |
| 94 19 939 U1 | 3/1995 | Germany | H01R 9/26 |
| 2037493 | 7/1980 | United Kingdom | 439/404 |

*Primary Examiner*—Kristine L. Kincaid
*Assistant Examiner*—Joseph Waks
*Attorney, Agent, or Firm*—Salter & Michaelson

[57] ABSTRACT

A front wiring clamp with cutting-clamping contacts is disclosed, which is reliable in operation even with large forces that act on pulling out the conductor or cross forces that act on the electrical conductor to be clamped. The front wiring clamp has stationary conductor uptake chambers in the insulation housing of the clamp, and each of these is assigned a tunable contact loop, whose foot end is mounted so that it can be turned by a turning link at or in the busbar or similar device and whose fork-shaped cutting-clamping head extends in the direction of turning motion of the contact loop.

14 Claims, 4 Drawing Sheets

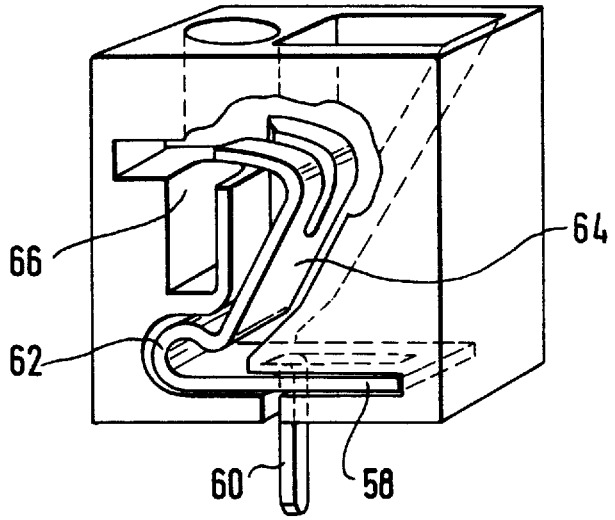
FIG.9
FIG.10
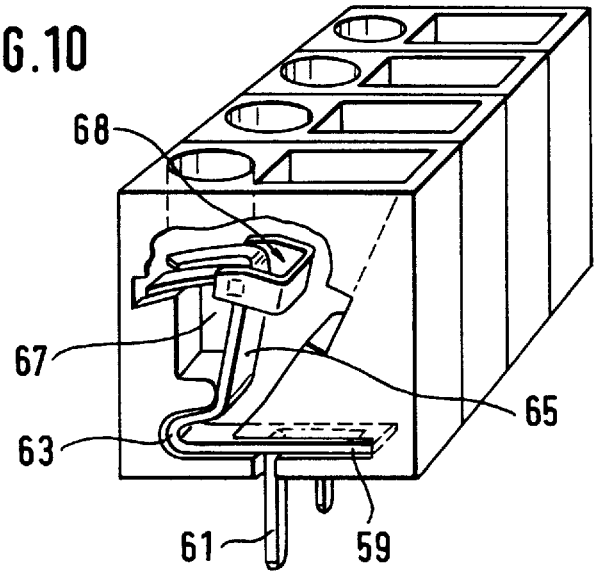

ELECTRICAL FRONT WIRING CLAMP

BACKGROUND AND SUMMARY OF THE INVENTION

The invention concerns an electrical clamp with an insulation housing and with at least one clamping site, whose actuation opening, and opening for introducing the conductor, are arranged in the same front surface of the insulation housing, so-called front wiring clamps.

Such front wiring clamps are preferred in practical application, since the clamping sites for incoming and outgoing electrical conductors lie in the direct field of view of the operator both with respect to the introduction of the conductor as well as with respect to actuation of the clamping site. In addition, front wiring offers a good overview also if more than two electrical conductors, e.g., four conductors (as is often usual in practice), must be wired with the same clamp, and in this way the space on the front surface of such a four-conductor clamp is very tightly proportioned.

With respect to the construction of clamping sites of front wiring clamps, it is generally required that these must be absolutely reliable in operation, i.e., they should not open up again by themselves in an undesirable way after the electrical conductor has been connected, in fact, not when increased conductor pulling forces or cross forces might operate on the clamped electrical conductor, as may occur, e.g., with tightly configured space ratios in the wiring of a clamping cabinet or, e.g., may be the case during operation and maintenance of a control device, for many other reasons.

Another requirement in practice consists of the fact that front wiring clamps shall be provided with a connection technology that does not require stripping of insulation. In this respect, a clamping site is desired, which is configured as a fork-shaped cutting-clamping contact, whose cutting edges penetrate the insulation of an insulated electrical conductor introduced into the opening for introducing the conductor as a type of known cutting connector. Front wiring clamps have not been known previously, which fulfill in a convincing manner all of the above-named requirements of practice. The task of the invention is to create such a front wiring clamp.

This task is resolved by the present invention in that the cutting-clamping contact of a clamping site of a front wiring clamp is shaped on the angled-out head end of a contact loop that can be turned, whose foot end is mounted in a way that can be turned by means of a turning link at or in the busbar, or similar structure, and its fork-shaped head extends in the direction of the turning movement of the contact loop, and that the electrical conductor taken up by the head of the contact loop is held in a stationary conductor uptake chamber in the insulation housing of the clamp.

A particularly advantageous form of embodiment of the instant invention is directed to shaping the turning link of the contact loop in two parts such that the foot end of the contact loop has two spring plug pieces lying one on top of the other, which engage in a stamped-out place of the busbar, printed circuit board, or the like.

An alternative form of embodiment of the invention provides for the fact that the turning link of the contact loop is configured as a one-part elastic link, which is shaped on the busbar or is attached to it.

Independent of the special form of embodiment of the turning link of the contact loop, the front wiring clamp of the invention has the advantage that the actuation of the contact loop by means of the actuation opening in the front surface of the clamp can be produced in the simplest way by means of a screwdriver, which is inserted into the actuation opening, whereby its tip seizes the back of the contact loop and which then penetrates into the insulation housing by inserting further, which is provided for this purpose with appropriate counter-pressure application surfaces for the screwdriver, and/or by an additional turning movement of the screwdriver turns the contact loop around its turning axis. Such a manipulation with a screwdriver, to actuate a clamping site is already well-known in the art, since clamps are constructed for bare [stripped] conductors, which are actuated in the same way, as a market leader for screw-less spring force clamp connections.

The actuation of the contact loop of a clamp according to the invention, which can be turned, is improved by the fact that a guide uptake for inserting the front end of the screwdriver is arranged on the back of the contact loop in such a way that the contact loop can be turned by means of an inserted screwdriver both in the closing direction of the clamping site as well as in the opening direction of the clamping site. The actuation of the clamping site will also be required in the opening direction in those cases in which a clamped electrical conductor must be loosened again for a later refitting of a part or a possible exchange of the conductor.

The tightly proportioned space ratios for front wiring clamps of this type were already mentioned in the introduction. Also, for the requirement of accommodating new contact loop clamping sites to the most constricted space possible, the invention makes available a convincing solution by the fact that the turning link of the contact loop is arranged essentially below the uptake chamber for the conductor in the direction of introducing the conductor. If the conductor uptake chamber and the turning link lie essentially below each other in one plane, then the dimensions of the contact loop/clamping site is limited crosswise to a minimum.

The front wiring clamp according to the invention is also excellently suitable for conductor connections to printed circuit boards or the like, in which it is generally important that the clamp is found in the closed state, i.e., in the case of a clamped electrical conductor, in an essentially force-free (voltage-neutral) resting state, and thus no connection forces are transmitted to the sensitive printed-circuit board or similar structure. For this purpose, it is proposed to use an elastic link as a turning link of the contact loop for the clamp according to the invention, which [link] is pre-shaped such that the contact loop must be drawn back in order to open the cutting-clamping contact and after the contact is closed against the force of the elastic link, the loop is moved back into its force-free resting position.

The cutting forces, which are exercised by the fork-shaped cutting edges, lying above one another on the contact loop head, on the insulation of an electrical conductor to be connected, are reinforced in one form of embodiment according to the invention, in that the guide uptake for the screwdriver, which has already been mentioned above, is provided on the back of the contact loop and that this is structured in the shape of a spring clip with two U-shaped clip arms lying above one another, which are applied in a force-reinforcing manner to the outer sides of the cutting-clamping contact at the head of the contact loop. Such a U-shaped head clip can be manufactured separately from the contact loop from a high-strength spring steel and then can be hooked onto the outside of the cutting-clamping contact at the head of the contact loop. However, in terms of manufacturing technology and for cost purposes, it is optimal to use a form of embodiment of the invention, in which the U-shaped clip is stamped out of the same material as the contact loop and made in one piece with the latter from the same strip-shape flat material, so that the foot end of the contact loop is stamped out roughly in the center of the material strip and the outside parts that are punched out of the material strip are pressed up with the arms of the U-shaped clip shaped thereon above the back of the contact loop at the head end of the contact loop and the arms of the clip are pressed around, so that the clip arms encompass the outside of the cutting-clamping contact at the head of the contact loop with the formation of the guide uptake for the screwdriver.

BRIEF DESCRIPTION OF THE DRAWINGS

Examples of embodiment of the invention will be described in more detail below on the basis of drawings. Here:

FIGS. 9 and 10 show a single-conductor connection clamp according to the invention.

DETAILED DESCRIPTION OF THE PREFERRED EMBODIMENTS

Figure 1:
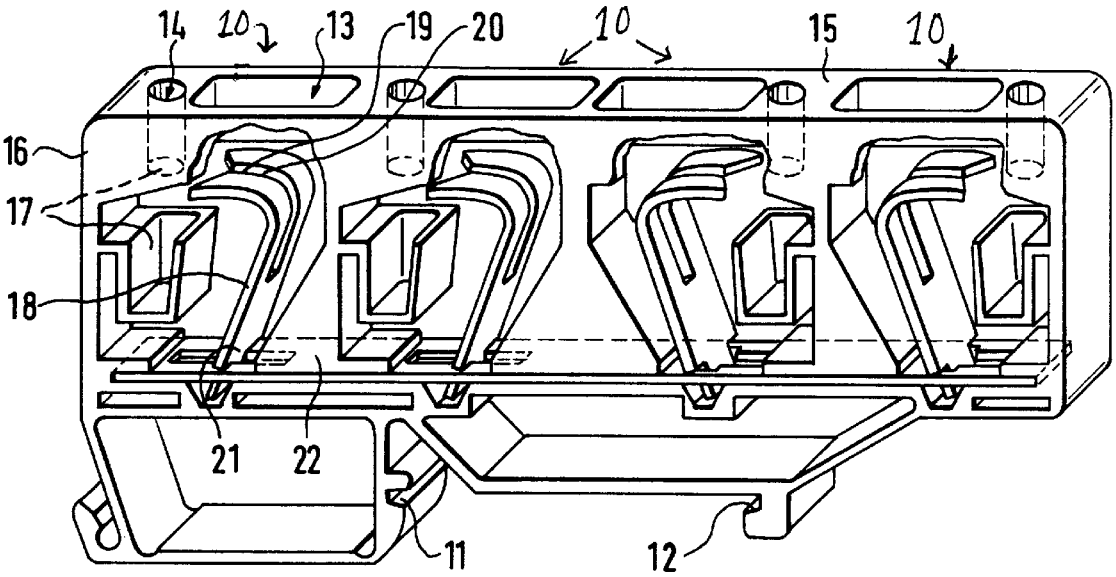
FIG. 1 shows a four-conductor front wiring clamp according to the invention in a perspective representation.

Referring now to the drawings, FIG. 1 shows a front wiring serial clamp, which is hooked by means of its catch pieces 11 and 12 onto a mounting rail (not shown) and which is a through-passage clamp with four clamping sites 10 for incoming and outgoing electrical conductors in the form of embodiment that is represented. An actuation opening 13 and a conductor introduction opening 14 are present in the front surface 15 of the insulation housing 16 of the clamp.

Figure 2:
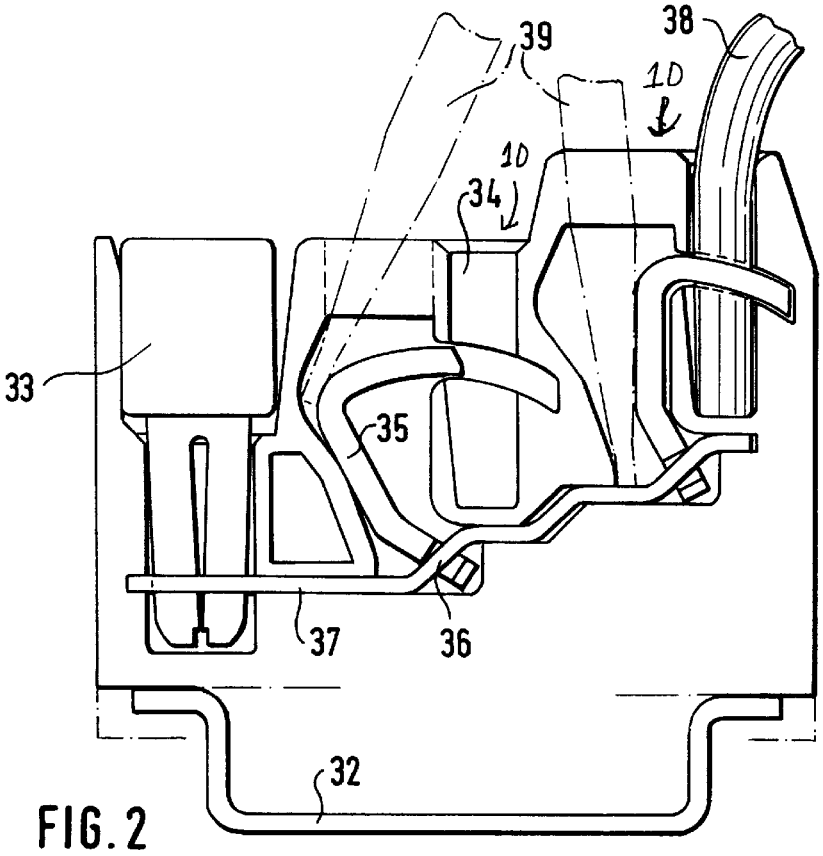
FIG. 2 shows the side view of a two-conductor front wiring clamp according to the invention.
Figure 8:
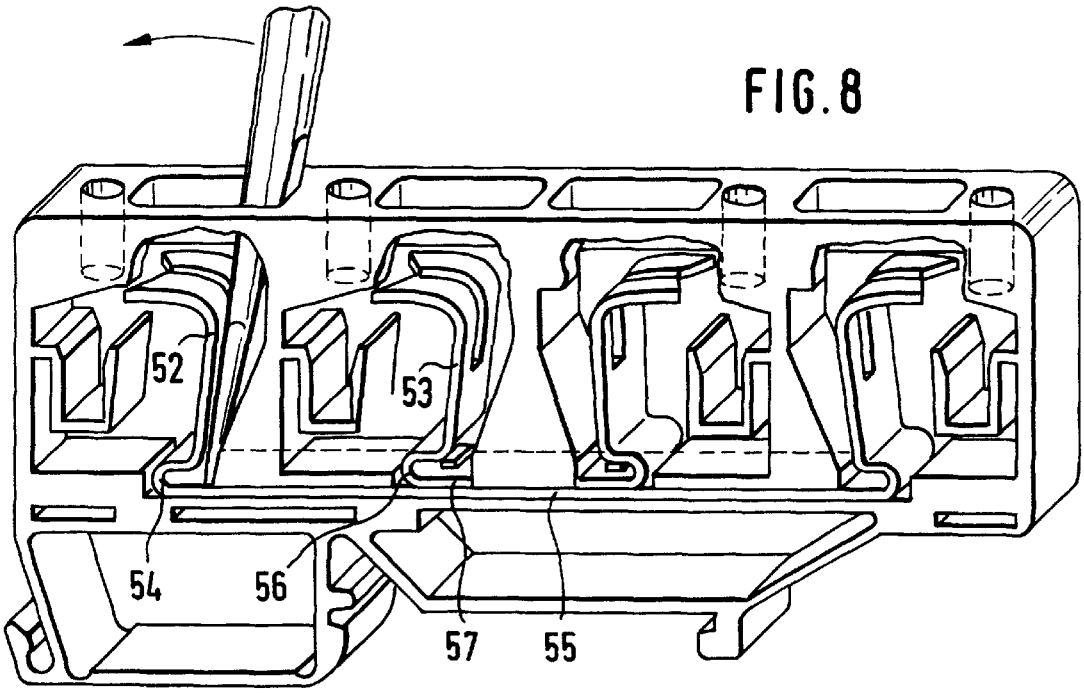
FIG. 8 shows another form of embodiment of a four-conductor front-wiring clamp according to the invention.

Each clamping site 10 is comprised of a conductor uptake chamber 17, in which a non-stripped electrical conductor is inserted through the conductor introduction opening 14, and which is formed from a turnable contact loop 18, whose bent-out head end is formed as a fork-shaped cutting-clamping contact with two inner-lying cutting edges 19, 20. The clamping site 10 is presented in its open position. After an electrical conductor has been inserted together with its insulation into the conductor uptake chamber 17, the clamping site is closed by inserting the tip of a screwdriver above actuation opening 13 behind the back of contact loop 18 into the insulation housing and is moved with contact loop 18 against the rigidly positioned electrical conductor in conductor uptake chamber 17 (as shown in FIGS. 2 and 8). This is achieved in such a way that the fork-shaped head of the contact loop, by means of its cutting edges 19 and 20, is contacted with the insulation of the electrical conductor, penetrates it, and thus contacts the latter.

The electrical conductor clamped by means of the cutting-clamping contact of contact loop 18 is securely attached in conductor uptake chamber 17 and held securely against undesired forces that might pull out the conductor. This is true also for undesired cross forces, which may operate on the conductor crosswise to the direction of insertion of the conductor and which might open the cutting-clamping contact in a clamp according to the invention, since the conductor is held securely in a stationary conductor uptake chamber in the insulation housing of the clamp.

Contact loop 18 in FIG. 1 possesses a turning link 21, which is made in two parts and found on the foot end of the contact loop. The foot end of the contact loop has an insertion piece that is engaged in a slot-shaped stamped-out place of busbar 22, i.e., engaged therein, whereby the piece parts that bound the stamped-out slot on the outside of busbar 22 may spring out somewhat.

Figure 3:
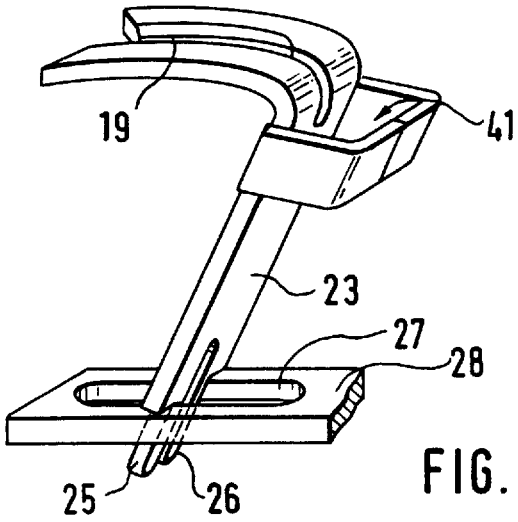
FIGS. 3–7 show detailed embodiments of the contact loop and the busbar or printed-circuit board for front wiring clamps according to the invention.
Figure 5:
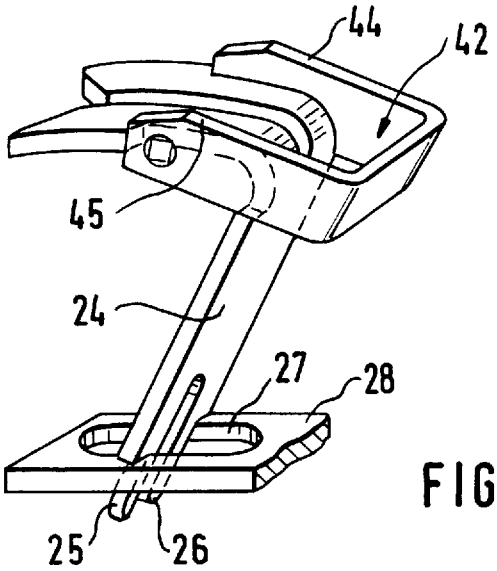

Another configuration of the turning link is shown in FIGS. 3 and 5. There, the foot ends of contact loops 23 and 24 each have two insertion tabs 25 and 26, which engage in a stamped out place in a busbar 28, whereby the insertion tabs of the foot end of the contact loop can spring in somewhat to catch the link parts securely.

Figure 6:
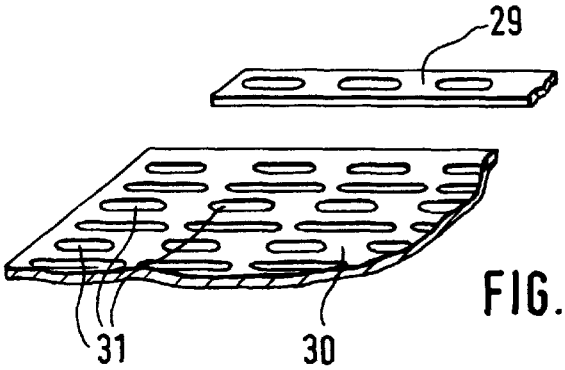

FIG. 6 shows that this simple configuration of a two-part turning link of the contact loop is excellently suitable for the purpose of integrating the turning link not only in a strip-shaped busbar 29, but also in a flat contact plate 30, which can also be a printed-circuit board or the like and which can have stamped-out places 31 for taking up the lower foot ends of the contact loops of a clamp according to the invention in any number and arrangement.

Figure 4:
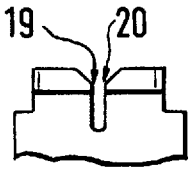

FIG. 4 shows in a front view toward the head of contact loop 23 in FIG. 3 that the head end formed as a cutting-clamping contact has two cutting edges 19 and 20, as is clearly known for cutting connectors. Such cutting edges are basically present in all cutting-clamping contacts of the contact loops shown in FIGS. 1 through 10, although they are not always drawn in with details for reasons of simplifying the drawing.

FIG. 2 shows a form of embodiment of a front wiring clamp, which has a structure that particularly saves space, so that, e.g., relative to the structural width of a conventional assembly rail 32, on which such front wiring clamps are to be engaged in the known way, two clamping sites 10 next to each other and one plug connection for a cross connector 33 can be accommodated. The clamping sites each again consist of a conductor uptake chamber 34 and a turnable contact loop 35, whereby the construction that saves space is achieved in that the turning link 36 is arranged below the conductor uptake chamber 34 between contact loop 35 and busbar 37. Thus, several stages pass through busbar 37 in steps, so that the clamping sites 10 are arranged at positions of different height relative to one another, which makes possible a further space-saving aggregation of the clamping sites.

FIG. 2 also shows the electrical conductor 38, which is completely surrounded by an insulation sleeve and is inserted into the conductor uptake chamber 34 and which is contacted by means of the cutting-clamping head of contact loop 35 after separating the insulation sleeve, as is shown in FIG. 2 in the right-hand clamping site. It is also illustrated in FIG. 2 how the tip of a screwdriver 39 engages the back of contact loop 35, and by continuing to insert the screwdriver into the insulation housing, the screwdriver deflects contact loop 35 to the right, as shown.

The cutting-clamping head of the contact loop may also be removed from the electrical conductor, i.e., the clamping site may be opened again. For this purpose, FIGS. 3, 5 and 7 show forms of embodiment of contact loops 23, 24 and 40, each of which has on its back side a guide uptake 41, 42, or 43 for inserting the front end of a screwdriver, by means of which the respective contact loop can be again withdrawn from an electrical conductor.

Guide uptake 41 in FIG. 3 is shaped in one piece from the flat material of the contact loop. It has only the function of guide uptake for the screwdriver. Guide uptake 42 in FIG. 5 is produced in the form of a U-shaped clip made of a high-strength spring steel with two U-shaped clip arms 44 and 45 lying opposite one another, which are applied in a force-reinforcing manner to the outside of the cutting-clamp contact at the head of contact loop 24.

Figure 7:
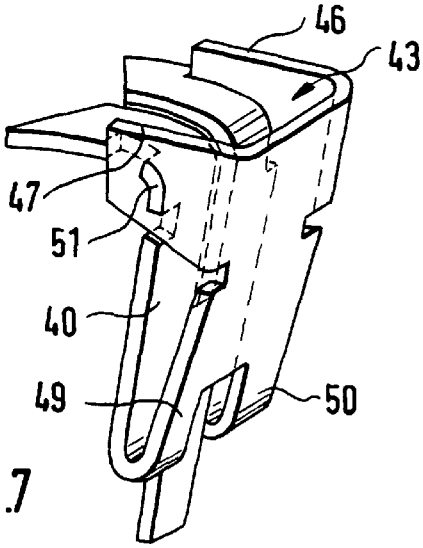

FIG. 7 shows a form of embodiment that can be manufactured in a cost-favorable manner according to manufacturing technology, in which guide uptake 43 also fulfills the additional function of a force-reinforcing clip, which is applied by its clip arms 46 and 47 to the outside of the cutting-clamping contact at the head of contact loop 40. In this way, the guide uptake with the clip function is stamped out jointly with contact loop 40 in a piece of the same strip-shaped flat material, such that foot end 48 of the contact loop is stamped out approximately in the center of the material strip, and the outside parts 49 and 50 of the material strip with the arms 46 and 47 shaped thereon of the U-shaped clip, which are released thereby, are pressed up over the back of contact loop 40 to the head end of the contact loop and clip arms 46 and 47 are engaged in side pieces 51 at the head of the contact loop.

FIG. 8 shows a form of embodiment of the front wiring clamp according to the invention, which is comparable to the one illustrated in FIG. 1. Differences are present only in the structural formation of the turning link of contact loops 52 and 53.

Contact loop 52 at its lower foot end possesses a one-part elastic link 54, which is shaped in one piece with the end piece of busbar 55. Opposite this, contact loop 53 possesses the same elastic link 56, but this changes into a busbar connection piece 57, which is riveted with busbar 55.

FIGS. 9 and 10 show single-conductor connection clamps for soldering into a printed-circuit board or into a contact plate of an electrical device or the like. For this purpose, a soldering pin 60 or 61 is formed on busbars 58 and 59.

Both single-conductor connection clamps are constructed in a manner that saves space, in which the respective turning link 62 or 63 of contact loop 64 or 65 is found essentially below the respective conductor chamber 66 or 67 in the direction of conductor introduction.

For the connection clamp according to FIG. 9, turning link 62 is pre-shaped such that contact loop 64 is found in its open position and must be turned to the left as shown into its closed position in order to close the cutting-clamping contact, by means of a screwdriver.

In the case of the connection clamp according to FIG. 10, turning link 63 is pre-shaped such that contact loop 65 is found in its closed state when the clamp is delivered, as this is shown. In order to connect an electrical conductor, contact loop 65 must be turned back into its open position by means of a screwdriver inserted into guide uptake 68, so that the electrical conductor (not shown) is inserted into conductor uptake chamber 67 and the cutting-clamping contact is again closed by means of the screwdriver.

The single-conductor connection clamps shown in FIGS. 9 and 10 are very simple and can be produced in a cost-favorable manner. They consist only of their insulation housing and a metal insert shaped in one piece, which comprises the contact loop, the turning link, the busbar, and the soldering pin.

What is claimed is:

1. Electrical clamp with an insulation housing comprising:

a front surface with at least one clamping site having an actuation opening, and an opening for introducing an insulated electrical conductor arranged in the front surface of the insulation housing, the clamping site including a cutting-clamping contact, which is joined electrically with a rigid busbar, said cutting-clamping contact having cutting edges for penetrating insulation of the insulated electrical conductor which is introduced into the opening for the conductor, wherein the cutting-clamping contact comprises a fork-shaped, bent-out head of a turnable contact loop, said contact loop having a foot end mounted to said busbar so that it can turn by means of a turning link in the busbar wherein said fork-shaped head extends in a direction of a turning movement of the contact loop; and wherein the electrical conductor is taken up by the forked-shaped head of the contact loop and is held in a rigid conductor uptake chamber in the insulation housing of the electrical clamp.

2. The clamp according to claim 1, the turning link of the contact loop being shaped in two parts such that the foot end of the contact loop has two spring insertion pieces lying opposite one another, which engage in a stamped-out place of said busbar.

3. The clamp according to claim 1, the turning link of the contact loop being shaped as a one-part elastic link, which is shaped on said busbar or is attached to said busbar.

4. The clamp according to claim 3, the elastic turning link of said contact loop being pre-shaped such that the contact loop is in a closed state when said elastic turning link is in a resting state that is essentially free of forces.

5. The clamp according to claim 1, the turning link of the contact loop being essentially arranged below the conductor uptake chamber.

6. The clamp according to claim 1 further comprising one or more soldering pins for soldering the clamp on a printed-circuit board, said soldering pin being shaped on the busbar.

7. The clamp according to claim 1 further comprising a guide uptake for permitting a front end of a screwdriver to be inserted therein, the guide uptake being arranged on a back portion of said contact loop such that the contact loop can be turned by means of said screwdriver both in a closing direction of the clamping site as well as also in an opening direction of the clamping site.

8. The clamp according to claim 7, the guide uptake being configured in a form of a spring clip with two clip arms lying opposite one another, the clip arms being applied in a force-reinforcing manner to an outside of the cutting-clamping contact at the fork-shaped head of the contact loop.

9. The clamp according to claim 8, the guide uptake being produced from a high-strength spring steel, which is engaged with the contact loop on the outside of the cutting-clamping contact at the fork-shaped head of said contact loop.

10. The clamp according to claim 8, the guide uptake being made of the same material as said contact loop and being stamped from one piece of a flat material strip, such that the foot end of said contact loop is stamped out at approximately a center of the material strip, wherein outside parts of said material strip form said clip arms which are pressed over said back portion of the contact loop to the fork-shaped head of the contact loop, and the arms of the clip are pressed such that said clip arms envelop the outside of the cutting-clamping contact at the fork-shaped head of said contact loop with the formation of uptake for the screwdriver.

11. An electrical clamp comprising:

a first opening for receiving an insulated electrical conductor; and a clamping contact comprising a cutting head having cutting edges at a first end thereof and being hingedly attached to a busbar at a second end thereof;

wherein said clamping contact is pivoted from said busbar to pierce an insulation of said electrical conductor.

12. The electrical clamp of claim 11, wherein said clamping contact comprises a strip of metal being bent at said first end to form said cutting head and wherein said cutting edges are formed on inside edges of a fork-shaped portion of said cutting head, whereby, when said clamping contact is pivoted to pierce the insulation of said electrical conductor, said electrical conductor presses between said cutting edges, which pierce said insulation.

13. The electrical clamp of claim 12, wherein said clamping contact is pivoted by a screwdriver inserted through a second opening of said electrical clamp.

14. The electrical clamp of claim 12, further comprising a guide uptake disposed on said clamping contact, said guide uptake permitting a screwdriver which is inserted through a second opening of said electrical clamp to pivot said clamping contact between an open position and a closed position, said closed position being when said clamping contact pierces said insulation of said electrical contact.

* * * * *